US005574268A

United States Patent [19]

Herman et al.

[11] Patent Number: 5,574,268

[45] Date of Patent: Nov. 12, 1996

[54] GAME DISPLAY COUNTER

[76] Inventors: Trent S. Herman, 4440 Meigs, Waterford, Mich. 48329; Randolph C. King, 220 Pine St., Imlay City, Mich. 48444; Jon D. Stroven, 2238 Hempstead, Auburn Hills, Mich. 48326

[21] Appl. No.: 346,874

[22] Filed: Nov. 30, 1994

[51] Int. Cl.[6] ..... G06M 1/00

[52] U.S. Cl. ..... 235/91 R; 116/223; 116/316; 116/317

[58] Field of Search ..... 235/91 R, 91 PR, 235/91 A, 91 B, 91 C, 91 D, 91 E, 91 F, 91 G, 91 H, 91 J, 91 K, 91 L, 91 M; 116/309, 316, 317, 223, 224

[56] References Cited

U.S. PATENT DOCUMENTS 1,263,571 4/1918 Larrabee ..... 235/91 R 3,722,461 3/1973 Forman ..... 116/223

*Primary Examiner*—Cassandra C. Spyrou
*Attorney, Agent, or Firm*—John R. Benefiel

[57] ABSTRACT

A table top two-digit game display counter is disclosed, in which a manually changeable player's score is displayed on two sets of wheels having numeric indicia inverted from each other for easy reading by the player and the other players. The counter is capable of displaying a score between 0 and 99, with each start and reset capabilities. By rotating a centrally located exposed thumb wheel, the player can incrementally change his score display either up or down by one, with each detented increment. When the ones display dial is rotated from nine to zero, or from zero to nine, a counter mechanism automatically rotates the tens wheel to the next digit.

18 Claims, 8 Drawing Sheets

FIG. 2
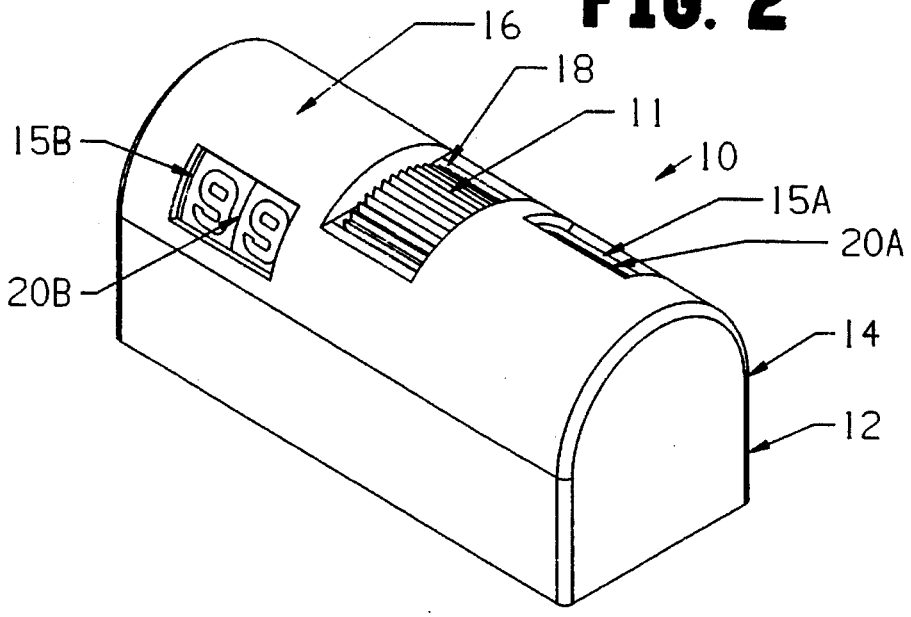
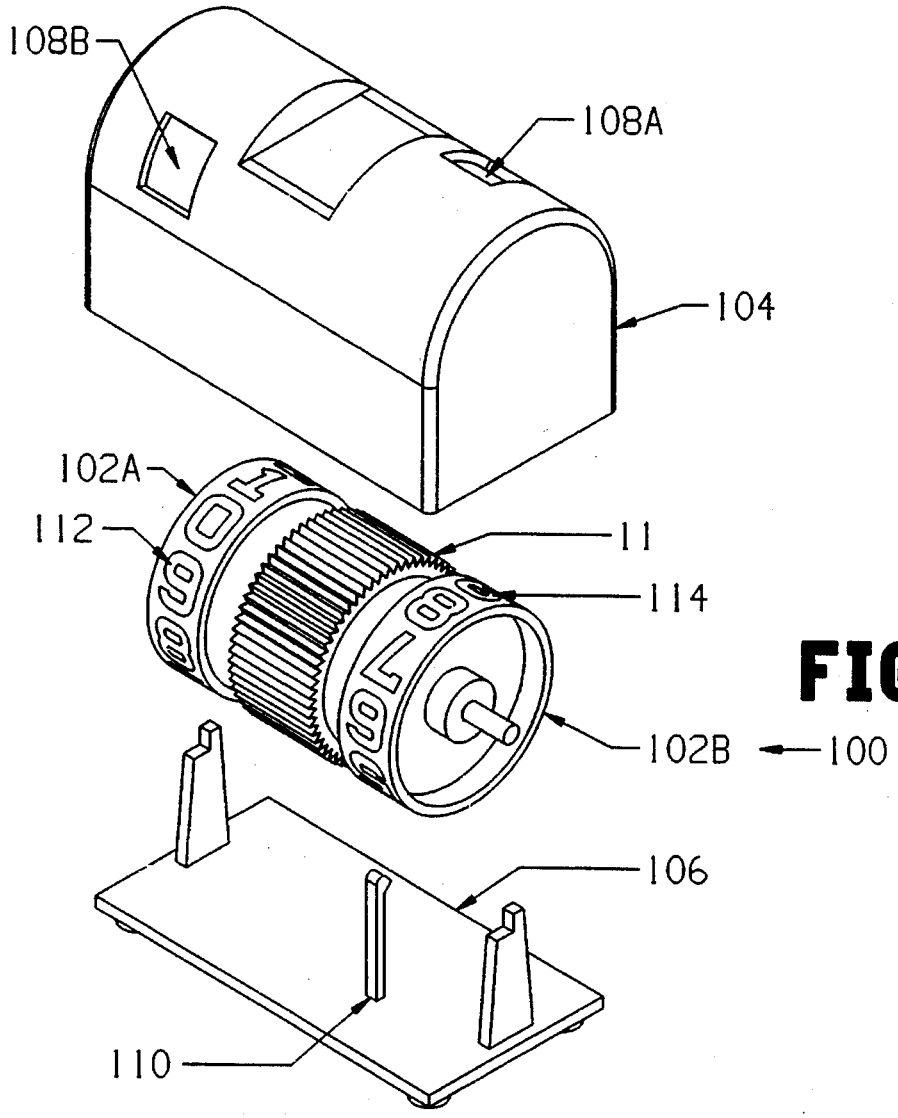
FIG. 9

FIG. 3
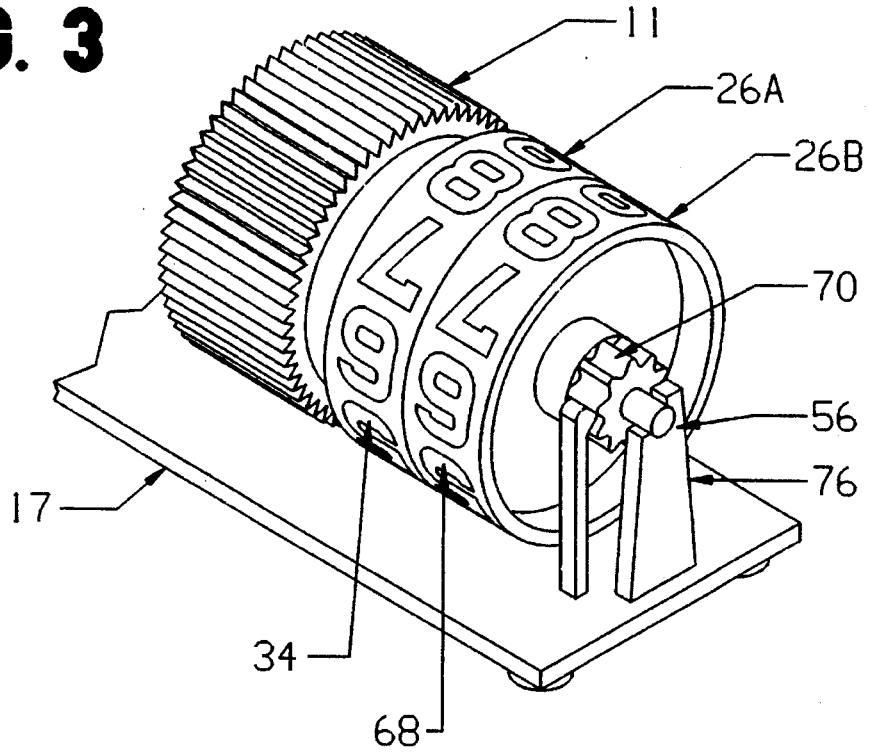
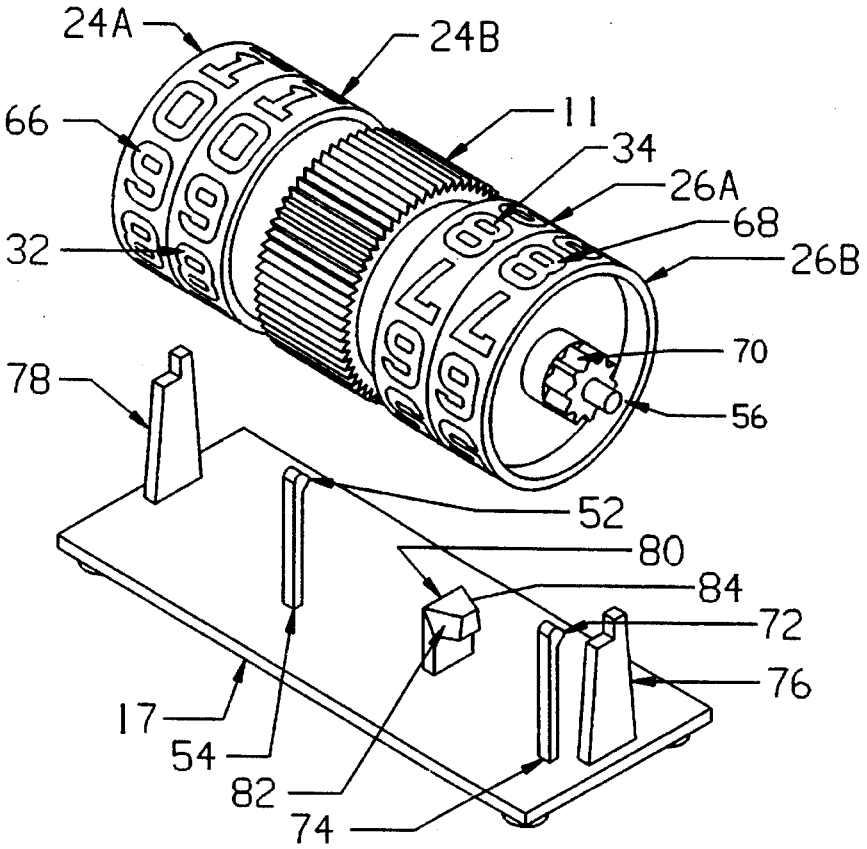
FIG. 4

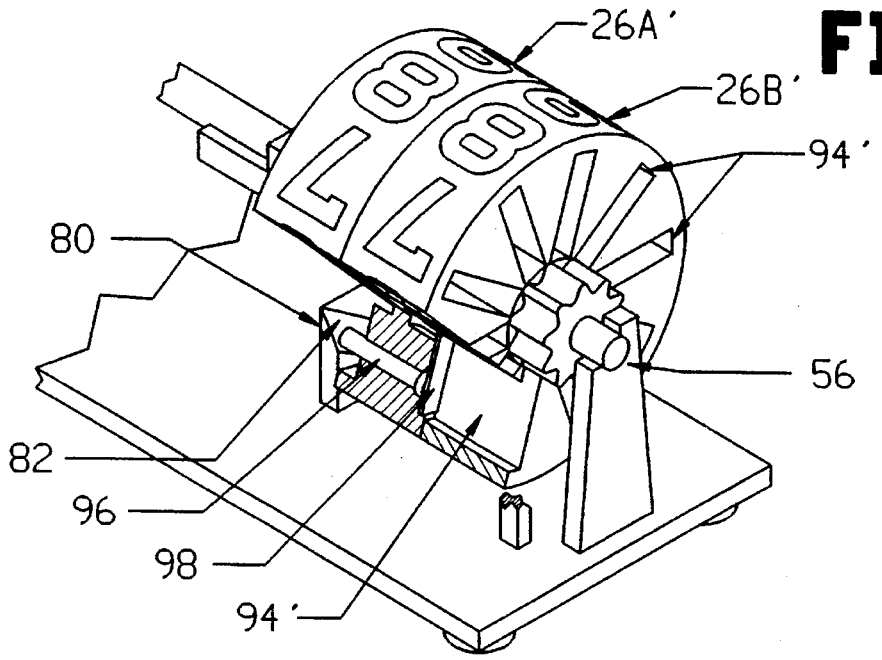
FIG. 7
FIG. 8
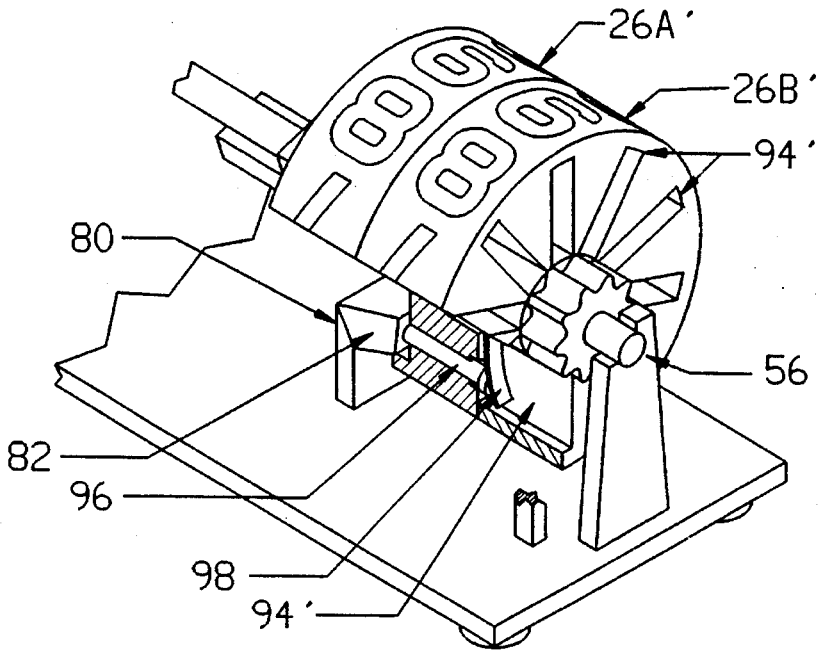

GAME DISPLAY COUNTER

BACKGROUND OF THE INVENTION

Some board games and many card games require the players to keep and make available their individual scores to the other players. Typically, one person assumes responsibility to keep score for everyone with paper and pencil. Ideally, each player should maintain his own score in a non-distracting, easily recognizable manner, and not take up excessive table space in the process.

There have heretofore been devised display counters for providing a running tally of a game score and its display to the players. McMurdo, U.S. Pat. No. 2,156,539 describes a counter specifically limited to use for bridge and keeps score for more than one player. Also, it does not display the scores so as to be easily read by all players seated at a table. The McMurdo counter does allow for automatic movement of a "tens" wheel after the "ones" wheel has been advanced ten increments, but does so with a relatively complex gearing, and does not insure centered positioning of the "tens" numerals.

Roy, U.S. Pat. No. 2,587,066 discloses a counter designed specifically for cribbage, with separately activated counter display for each of the two players, the displayed count for each player is not easily read by the other player. This disclosed counter also has no means to decrease the displayed score.

Veen, U.S. Pat. Nos. 2,818,214 and 2,572,784 shows counters which display the score in only one direction and requires the depression of individual levers to advance each wheel separately. There is no automatic activation of the tens wheel by the ones wheel.

Forman, U.S. Pat. No. 3,722,461 describes a counter display which is not self-contained and requires installation into a separate, pre-existing housing. It provides only one display for each player, and has no automatic advancement of the tens wheel by the ones wheel requiring independent rotation from the player.

It is important that such devices be simple and low cost, as well as be compact and attractive in appearance.

It is an object of the present invention to provide a display counter suitable for game scoring which enables independent tallying for one player and to be displayed so as to be easily read by all players.

It is also another object to provide a display counter capable of increasing and/or decreasing the score with equal simplicity, with a means to set the initial starting score.

It is another object to provide a display counter capable of tallying and displaying up to two-digits of count, in which the tens digit is automatically advanced or decreased with the ones count without requiring a complex mechanism and with accurate tens digit placement to avoid ambiguous displays.

SUMMARY OF THE INVENTION

The above objectives are achieved by a display counter suited for tallying and displaying one player's game score duplicated in separate inverted displays so as to be easily read by all players seated around a table.

The display counter according to the invention consists of a compact table top housing enclosing two pairs of side by side rotatable display counter wheels bearing relatively inverted oriented numeric indicia arranged in a 0–9 sequence, individually viewable through oppositely located windows formed in the housing.

The numeric indicia of each side by side wheel pair respectively represents ones digits and tens digits, with both ones digit wheels rotated by an intermediate thumb wheel, having a portion of its perimeter accessible through a housing opening and to be rotatable in either direction through successive detented positions to advance or reduce the count shown by the display counter wheels.

The tens digit display counter wheel of each pair is connected to the other tens digit display counter wheel both rotatable through ten successive detented increments, but are not rotated by rotation of the ones digit display wheels, until the end of a complete revolution of the ones digit display wheels. At that point, a cam activated coupling arrangement acts between the ones and tens digit display wheels during the next incremental movement to advance or retract the tens digit display wheels a single detented increment.

The coupling arrangement comprises a coupling element carried by one of the ones digit display counter wheels shifted to engage a tens digit display counter wheel by a stationary cam engaged as the ones digit display counter wheel rotates between the 0 and 9 digits in either direction.

The coupling element may comprise a slidable pin, an integral finger, or a pivoted trip lever, the element resiliently urged to a return passive position after the cam action ceases to couple the ones and tens digit display counter wheels.

Each of the ones and tens digit display counter wheels may be of injection molded plastic, with each of the ones and tens digit display counter wheels identical to its counterpart in the other pair of display counter wheels.

Cam and detent members are preferably molded into a housing base, such that only a minimum number of separate parts is employed.

The counter may also be configured in a simplified single digit form, in which only ones digits display counter wheels are employed, having relatively inverted numeric indicia viewable singly through respective housing windows.

The player changes his score by rotating the central thumb wheel in one direction to increase his score, and the other direction to decrease his score, which is easily readable by the player from one set of display wheels, and by any opponents from the inverted display wheels. For every one tenth of a whole revolution of the ones digit display wheel, perceptible to the player by a detent, the score changes by one unit. When the ones digit display wheel passes between the nine and zero digits, one of the ones digit display wheels is coupled to the adjacent tens digit display wheel and automatically rotates both tens digit display counter wheels along with it to the next successive digit.

BRIEF DESCRIPTION OF THE DRAWINGS

FIG. 2 is an isometric view of the assembled counter as shown in FIG. 1.

FIG. 3 is an isometric, enlarged view of one set of the display wheels and detent elements.

FIG. 4 is an isometric view of an assembled axle rod both pairs of display counter wheels.

FIG. 7 is an enlarged isometric fragmentary view of one set of display counter wheels and associated components with a slidable pin as an alternate coupling arrangement for causing engagement between the ones digit display counter wheel and the tens digit display counter wheel prior to coupling of said wheels.

FIG. 8 is a view of the components as shown in FIG. 7 but with the slideable pin coupling engagement of the ones digit display wheel with the tens digit display wheel.

FIG. 9 is an isometric view of another embodiment of the game display counter according to the invention having only ones digit display counter wheels.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
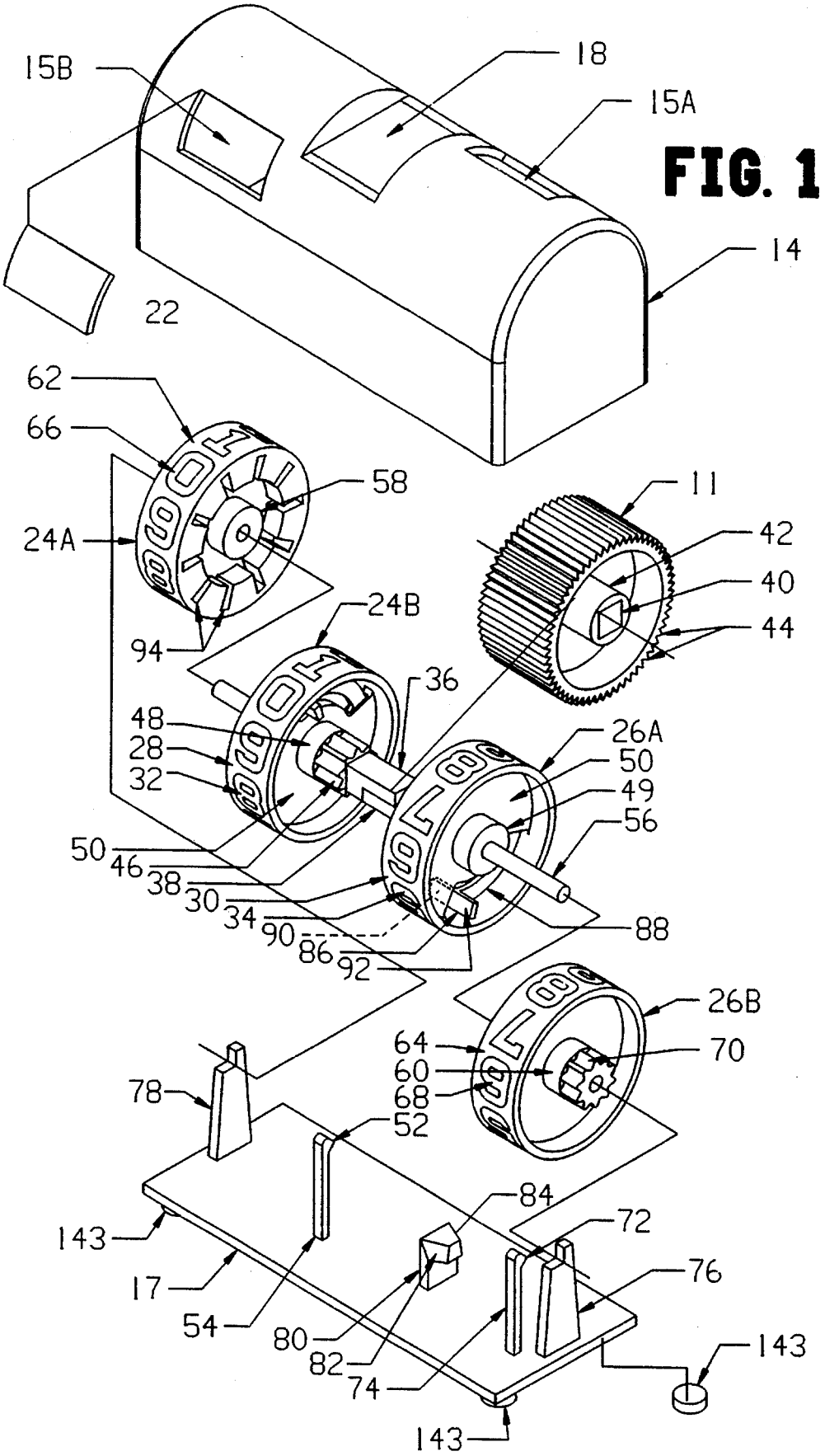
FIG. 1 is an isometric exploded view of the display counter.
Figure 5:
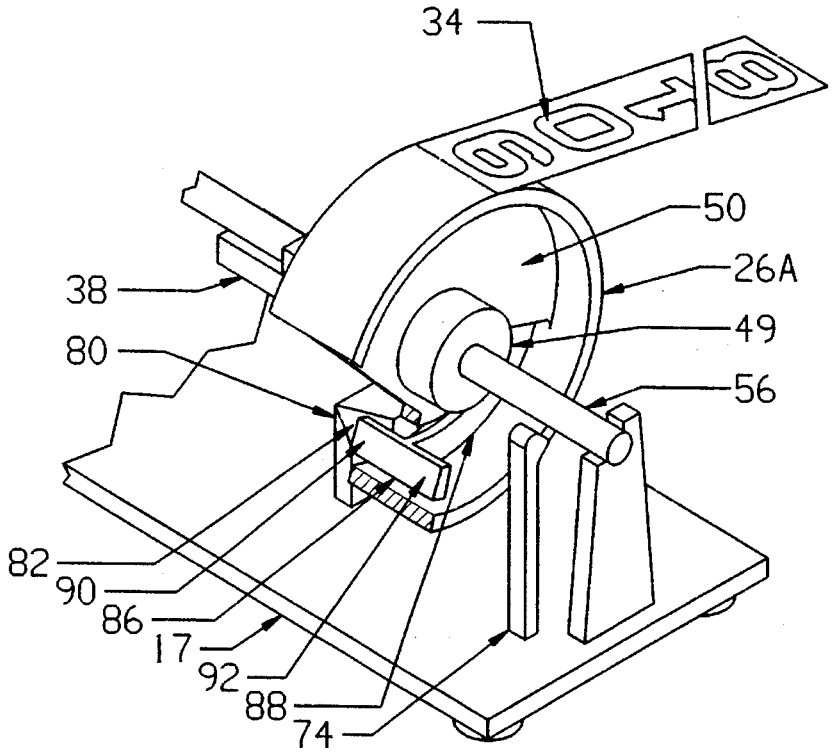
FIG. 5 is an enlarged isometric fragmentary view of one of the one digit display counter wheels and associated components, showing the coupling key in relationship to an actuator, prior to coupling engagement with the tens digit display counter wheel.
Figure 6:
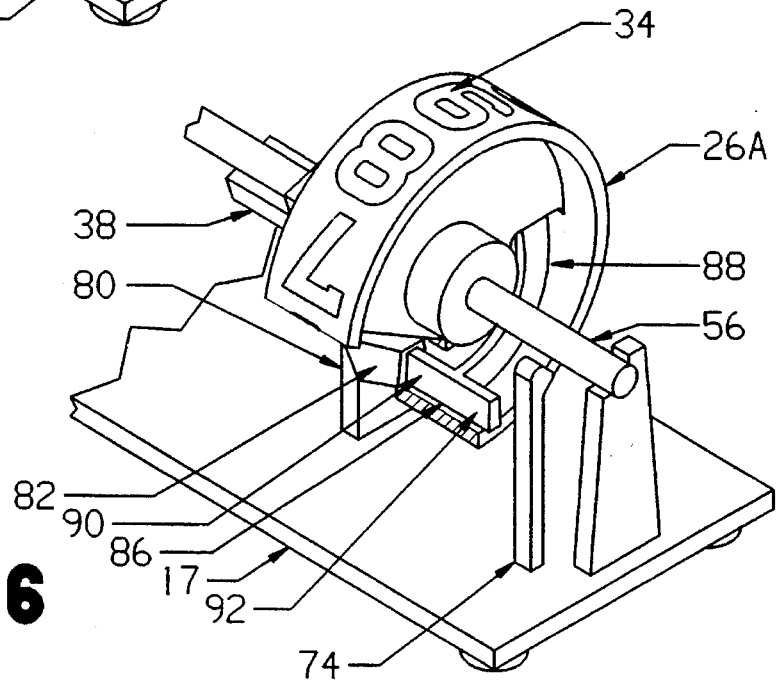
FIG. 6 is a fragmentary perspective view of the components as shown in FIG. 5, but with the coupling key engagement of the onbes digit display wheel during coupling engagement with the tens digit display wheel.
Figure 10:
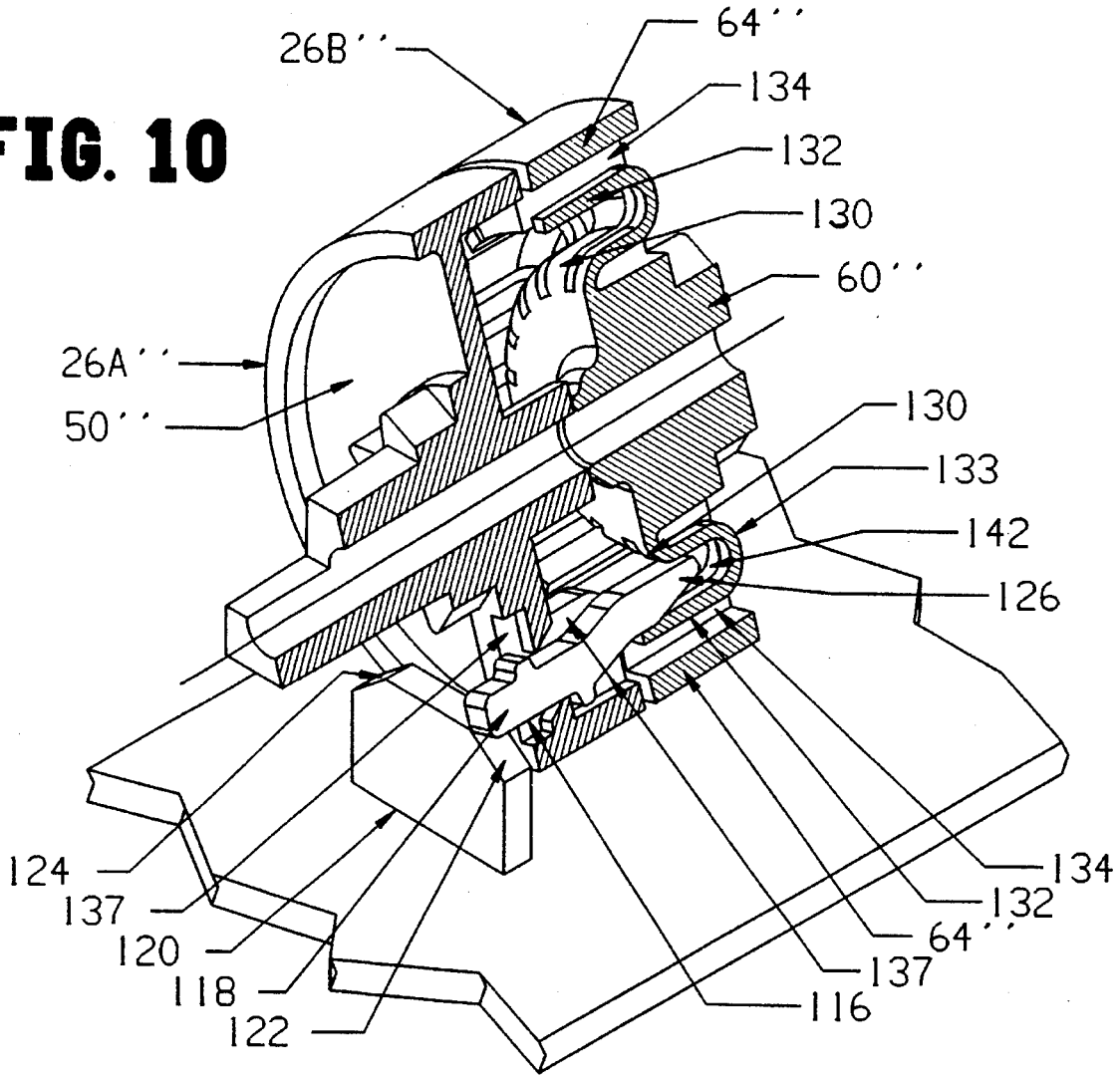
FIG. 10 is an isometric fragmentary view of a ones digit display counter wheel with another form of coupling arrangement using a pivoted trip lever, in a position prior to coupling engagement with the tens digit display counter wheel.
Figure 11:
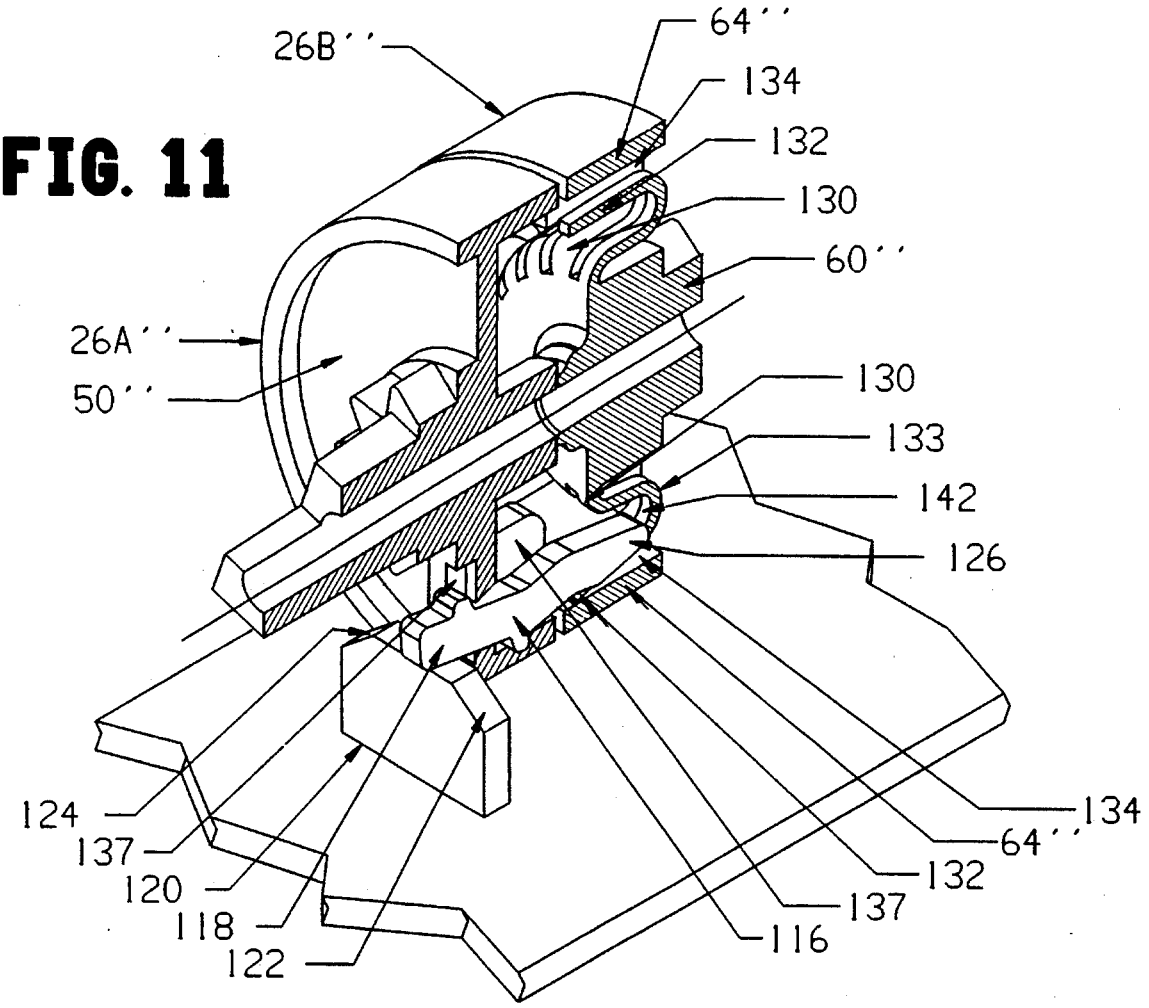
FIG. 11 is an isometric view of the components as shown in FIG. 10 with the pivoted trip lever in a position assumed during coupling engagement with the tens digit display counter wheel.

Referring to the drawings and particularly FIGS. 1 and 2, the game display counter 10 according to the present invention comprises a housing 12 consisting of a cover 14 and a base 17. The cover 14 has a semi-cylindrical upper surface 16 provided with a pair of display windows 15A, 15B located at opposite ends of the cover 14 and opposite sides of the semi-cylindrical top shape 16 such as to be facing in opposite directions. The cover 14 is also provided with a central opening 18 in the top surface 16 thereof through which protrudes a portion of the perimeter of the knurled thumb wheel 11 such as to be accessible to enable advance of the thumb wheel 11 in either rotative direction. This causes the score displayed by a two-digit numeric display 20A, 20B in the respective windows 15A, 15B to be increased or decreased depending on the direction of rotation of the thumb wheel 11.

The same score is displayed in each window inasmuch as the rotation of the thumb wheel 11 in either directions causes simultaneous count-up or count-down of both numeric displays.

The base 17 is rectangular with attached pads 143 affixed to its bottom side. The base 17 is sized to interfit into the bottom of the cover 14 such as to be able to rest on a table top surface. The display counter 10 thus is intended to rest on a table top in front of an individual player who maintains a tally of his own game score, which score is displayed so as to be visible both to himself and to all other players.

Window 15B is provided with a clear plastic cover piece 22 as shown in FIG. 1, while the other window 15A remains open for a purpose to be described hereinafter.

The respective numeric displays 20A, 20B are created by viewing a portion of the perimeter of respective pairs of counter wheels 24A, 24B and 26A, 26B, mounted on edge for rotation about a horizontal axis 56 within the housing 12, each aligned with respective windows 15A, 15B. The width of the windows 15A, 15B is such as to enable viewing of the limited portion of the perimeter of both of the counter wheels 24A, 24B, 26A, 26B in each set.

All of the counter wheels 24A, 24B, 26A, 26B are mounted for rotation on a common horizontal axis 56 with the counter wheels in each set, i.e., 24A, 24B and 26A, 26B mounted side-by-side closely adjacent to each other. There is provided between the respective counter wheel sets into which is received the thumb wheel 11.

The respective numeric displays provided by the counter wheel sets are oppositely oriented since they are viewed through display windows 15A, 15B on opposite sides of the semi-cylindrical top surface 16 of the cover 14. The numeric displays 20A, 20B are two-digit, i.e., with a ones digit and a tens digit. The ones digits and tens digits are provided by the indicia carried by the respective counter wheels in each counter wheel set. The figures illustrate the game counter as viewed by a facing opponent. Due to the opposite orientation of the displays, the ones digit is provided by the left hand counter wheel 26A of the right hand set of counter wheels but the ones digit is on the right hand display counter wheel 24B in the left hand set of counter wheels as viewed in FIG. 1.

Each of the ones counter wheels 24B and 26A are permanently coupled together after assembly together with the thumb wheel 11 such as to be rotated unitarily together in either direction upon rotation of the thumb wheel 11 in either direction.

Each of the ones counter wheels 24B and 26A are of identical configuration preferably constructed of injection molded plastic. Each of the ones counter wheels 24B, 26A is formed with a narrow cylindrical outer rim 28 and 30 respectively bearing a numeric indicia sequence 32, 34 respectively in order from 0–9.

The sequence proceeds in the same direction on each wheel, i.e., counting up in a clockwise direction and down in a counter-clockwise direction, but the indicia are inverted with respect to each other such as to appear right side up from the respective windows 15A, 15B.

Additionally, since the portion of the perimeters of the rim portions 28, 30 viewable through the respective windows 15A, 15B is circumferentially shifted, the numeric indicia 32, 34 are circumferentially shifted in their respective locations with the counter wheels 24B, 26A fastened together. For example, the numeral 9 is located to the forward side of counter wheel 24B as viewed in FIG. 1 but is to the rear side of counter wheel 26A as viewed in FIG. 1.

The counter wheels 24B, 26A must thus be secured together with the numeric indicia 32, 34 in the proper relationship with respect to each other. This securement is provided by mating flat drive features 36, 38 formed on projecting stub shafts integral with a respective counter wheel 24B, 26A. The flat drive features 36, 38 comprise rectangular shapes which interfit to form a square drive feature which collectively mate with a square opening 40 formed through a hub 42 of the thumb wheel 11. Thus, the ones counter wheels 24B, 26A and the thumb wheel 11, when assembled, form a unitary assembly rotating together with the numeric indicia 32, 34 properly related to each other such as a increasing and decreasing count is displayed in the respective windows 15A, 15B depending on the direction of rotation of the thumb wheel 11.

The thumb wheel 11 is preferably provided with axial grooves 44 on the outer surface thereof to provide a knurled surface.

Each ones counter wheel 24B, 26A is also engaged with detent means to be releasably positioned in successive incremental position provided by integral detent cogs 46. Only the cogs 46 on ones counter wheel 24B are visible in the drawings.

The detent cogs 46 project beyond the width of the cylindrical rims 28 due to the presence of a spacer hub portion 48 located within the outer rim 28. The hub 48 projects from the central web 50. In this position, detent cogs 48 are positioned to be engaged with the wedge faced tip 52 of an upwardly projecting detent post 54 integral with the base 17. The location of the detent post 54 and wedge faced tip 52 is such that the tip 52 is normally interfit into the spaces between successive teeth of the detent cogs 46 to releasably hold the counter wheel 26A in each detented incremental position at which the numeric indicia of each ones wheels are properly in register with the display windows 15A, 15B. Upon exerting a turning force to the thumb wheel 11 the wedge faced tip 52 is cammed out from the cog 46, the resiliency of the detent post 54 accommodating this deflection such as to allow rotation of the detent cog 46 as the thumb wheel 11 is advanced in either direction. This detent means establishes a located position in each of the ten increments of rotation corresponding to the ten numeric spaces on the outer band 28. This detenting action insures that each numeric indicia 32, 34 is centered in the respective windows 15A, 15B.

The other ones wheel 26A is also provided with detent cogs (which is not visible in the drawings), but which is non-functioning inasmuch as only a single detent mechanism is required due to the connection together of the units counter wheels 24B, 26A as previously described.

The thumb wheel 11 and each of the ones counter wheels 24B, 26A are freely rotatable on a steel axle rod 56 extending lengthwise through the hub portions 48 and 49. The axle rod 56 is received in each of the tens counter wheels 24A, 26B through bores in the hubs portions 58 and 60 respectively.

The tens counter wheels 24A, 26B are press fit to the opposite ends of the axle rod 56 such as to be rotatably fixed relative to the rod and each other but not with respect to the ones counter wheels 24B, 26A.

Each of the tens counter wheels 24A, 26B is also provided with an outer cylindrical rim 62, 64 which bear numeric indicia 66, 68 arranged in a sequence from 0–9 with the respective indicia 66, 68 sequencing in the same direction, i.e., counting up in a clockwise direction and down in a counter-clockwise direction as viewed in FIG. 1, but with the respective indicia 66, 68 inverted with respect to each other since viewed through display windows 15A, 15B positioned on opposite sides of the counter wheel sets.

Each tens counter wheel 24A, 26B is identically configured and preferably of molded plastic construction. Each includes integral detent cogs with only the detent cogs 70 of the right-hand tens digit 26B visible in the drawings, forming a part of a separate detent means associated with the tens counter wheels 24A, 26B.

The detent cogs 70 project outwardly from within the outer rim 64 of the counterwheel 26B such as to be engagable with the wedge faced tip 72 formed on a detent post 74 integral with the base 17. The wedge faced tip 72 is configured to interfit into the spaces between successive teeth of the detent cogs 70 and releasably locate both the tens counter wheels 24A, 26B in defined detented incremental positions corresponding to the position of the ten indicia 66, 68 in registry with the respective display windows 15A, 15B.

The numeric indicia 66, 68 are aligned with each other, but with the same digits located in circumferentially shifted positions corresponding to the different locations of the display windows 15A, 15B.

The detented positions of the tens counter wheels 24A, 26B are such as to align these indicia with the indicia on the corresponding ones wheel 24B, 26A in each of their detented positions, so that the same two-digit score number display is presented at each of the display windows 15A, 15B.

The axle rod 56 projects beyond the detent cogs 70 of each tens counter wheel 24A, 26B respectively and rest in pedestals 76, 78 formed at either end of the base 17, thus supporting the entire assembly of the counter wheel sets 24A, 24B, 26A, 26B, the thumb wheel 11 and the axle rod 56.

The tens counter wheels 24A, 26B are not rotated by the thumb wheel 11, but remain held in a detented position as the thumb wheel 11 is advanced in either direction carrying only the ones wheels 24B, 26A to increase or decrease the displayed score counts. However, at the transition between the 0 and 9, a coupling arrangement is activated which utilizes an axially movable coupling element which selectively couples the ones wheels 24B, 26A to the tens counter wheels 24A, 26B such as to advance or reduce the tens digit count for one increment of rotation.

This coupling arrangement in the embodiment shown in FIGS. 1–6 includes a fixed cam block 80 integral with the base 17 having opposite sloping cam surfaces 82, 84 which project into the space within the rim of the ones wheel 26A. The ones counter wheel 26A is provided with a horizontally extending locking finger 86 comprising the coupling element at the end of a resilient arcuate web 88. The finger 86 has one end 90 projecting axially such as to be engagable with either cam surface 82, 84 and another end 92 projecting axially in the opposite direction which may be received within one of a series of radial slots 94 extending axially into the rim portion 64 of the tens counter wheel 26B. When finger 86 is advanced into a slot 94, the ones wheels 24B, 26A are coupled to the tens counter wheels 24A, 26B to be rotated together.

Each of the slots 94 must be aligned with the projecting end 92 in each detented location of the counter wheels 26A, 26B. This alignment is accomplished by properly set detent positions of the tens counter wheels 24A, 26B and the ones counter wheels 24B, 26A.

The cam faces 82, 84 are engaged in only a single incremental change in position of the counter wheel sets which occurs at the transition between the 0–9 indicia characters on the ones counter wheels 24B, 26A. If cam face 82 acts to engage finger end 92, then cam face 84 allows retraction of finger end 92 and vice versa.

The resilience of the arcuate web 88 causes the finger end 92 to be retracted to decouple the ones counter wheels 24B, 26A from the tens counter wheels 24A, 26B during the rotation of the ones counter wheels 24B, 26A.

Accordingly, the tens digits are counted up or counted down one count per each full rotation of the ones counter wheels to thus provide the two digit numeric indication of a tallied score automatically.

The tens wheel 26B can be manually set at the beginning of a game to any desired count by access through the open display windows 15A if desired.

Referring to FIG. 7, an alternate coupling arrangement is shown in which the ones counter wheel 26A' is configured with an axial bore slidably receiving a coupling pin 96 comprising the coupling element which is located to be engagable with the cam surfaces 82, 84 of the cam block 80.

The tens counter wheel 26B' is provided with a leaf spring 98 located at the entrance to each of the radial slots 94'. The slots 94' are sized to enable entry of the coupling pin 96 when cammed axially by the cam surface 82, 84 as the ones wheel 26A' is rotated past the cam block 80. As shown in FIG. 8, the leaf spring 98 is deflected by the coupling pin 96 as the pin 96 is cammed into a respective slot 94'. This provides a spring retraction force acting on the pin 96 after the pin 96 moves past the cam block 80 to again decouple the tens counter wheels 26B' and 24A' from the ones counter wheels 24B', 26A'.

FIG. 9 illustrates a simplified version of the display counter 100 in which a pair of ones counter wheels 102A, 102B are provided rotatably mounted within the housing comprised of a cover 104 and a base 106 with attached pads 143 affixed to its bottom side, and configured as in the above described embodiment but with having smaller display windows 108A, 108B.

Tens counter wheels are not provided nor are the coupling arrangement necessary for this single digit display. Numeric indicia 112, 114 are arranged on respective wheels counting up and down in the same direction but inverted such as to be readable from opposite windows 108B, 108A formed into the cover 104. The ones counter wheels 102A, 102B embody detent cogs (not visible in FIG. 9) with one set interacting with a detent post 110 integral with the base 106.

Figure 12:
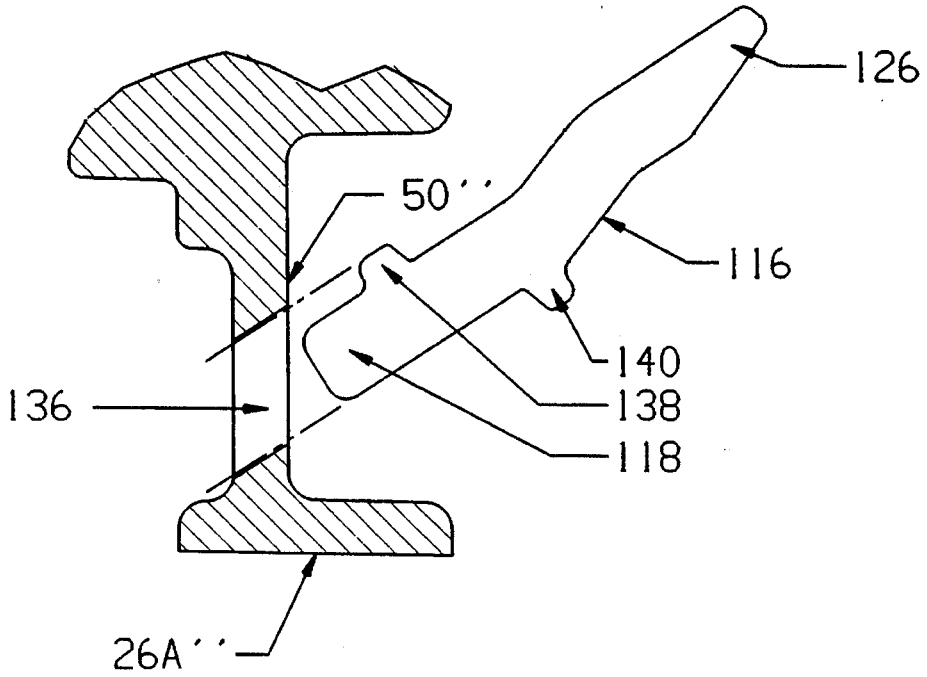
FIG. 12 is a greatly enlarged fragmentary and sectional view of the ones digit display counter wheel and a disassembled pivot lever used in the embodiment of FIGS. 10 and 11.

FIGS. 10 through 13 show another form of the coupling arrangement. In this coupling arrangement, the ones coupling wheel 26A" mounts a locking key 116 here comprising the coupling element, which extends axially through an angled opening 136 in the web 50", guided between wall protrusions 137. The locking key 116 includes a tail portion 118 engagable with a cam block 120. The cam block 120 has opposite cam faces 122 and 124 engagable with the key tail portion 118 as the ones counter wheel 26A" rotates between the 0–9 digit indicia in either direction. The coupling key 116 also includes a nose portion 126. Staggered square retainer protrusions 138, 140 are formed on opposite sides of the locking key 116. The width of the opening 136 is sufficient to accommodate the width of the key 116 and one of the retainer protrusions 138 such as the locking key 116 can be inserted therein when inclined as shown in FIG. 12.

Figure 13:
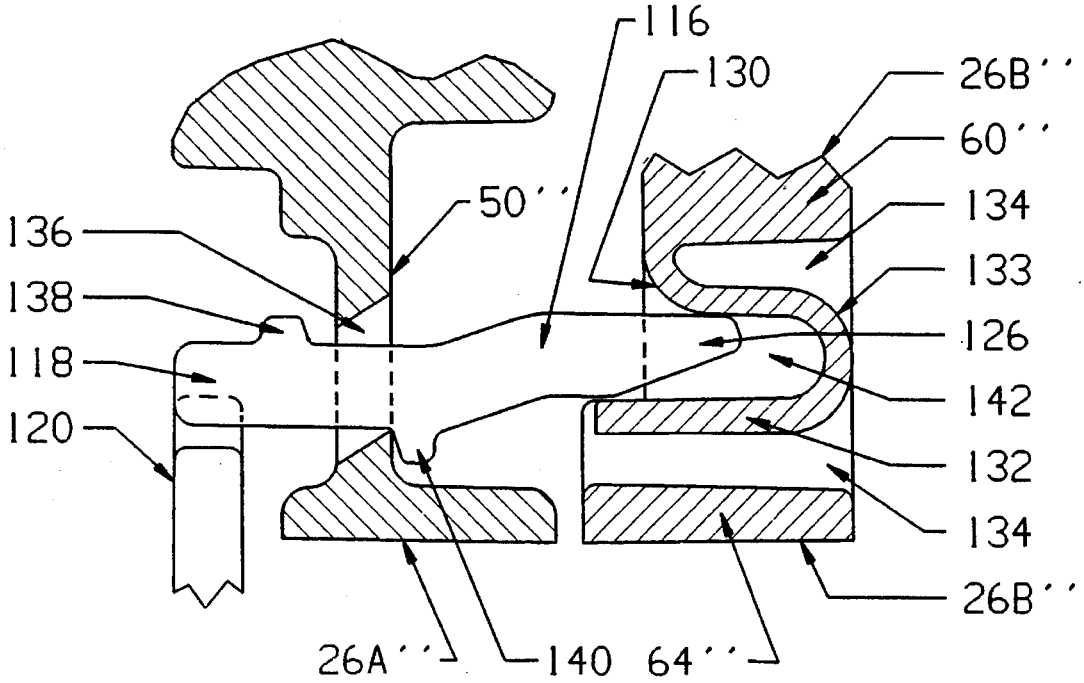
FIG. 13 is a greatly enlarged fragmentary sectional view of the ones digit and tens digit display counter wheels, as well as the pivot lever shown in coupling engagement with the ones digit display wheel and of the tens digit display wheel in assembled position, with the pivot lever also in assembled position within the display counter wheels.

As seen in FIG. 13, upon releasing the key 116, the key 116 is trapped with the locking protrusions 138, 140 on either side of the web 50". Insertion of the nose portion 126 into annular space 142 formed by the reversely curved webs 130 and fingers 132 of the tens counter wheel 26B", retains the locking key 116 in the generally horizontal position preventing inadvertent movement of the locking key 116 out of the opening 136 by virtue of the locking effect exerted by the protrusions 138, 140.

The tens counter wheel 26B" is formed with reversely curved webs 130 intermediate the outer rim 64" and the hub 60" forming an annular space 142. A series of slots 134 are formed by spaces between the webs 130 as shown, which are occupied by reversely bent thinner fingers 132, each of which having a spring portion 133 which partially occupies the space defined by slots 134 to provide a return spring force urging the coupling key 116 back out of the slots 134 deflected upon entry of the portion 126 of the coupling key 116 out of the slots 134. The nose portion 126 is sufficiently wide to bridge the gaps between the webs 130 and fingers 132 so that the portion 126 can rotate through the annular space 142 without entering a slot 134.

Accordingly, as the cam face 122 or 124 is engaged with the portion 118, the portion 126 is forced to pivot down into one of the slots 134 against the resilient force exerted by the finger 132. Upon entering one of the slots 134, the ones counter wheel 26A" and the tens counter wheel 26B" are coupled to rotate together and advance the tens indicia by one count as the ones counter wheel 26A" passes between the 0 and 9 indicia enters in either direction.

After passing by the block cam 120, the deflected spring finger 132 retracts the portion 126 of the locking key 116 to again decouple the ones counterwheel 26A" from the tens wheel 26B".

We claim:

1. A display counter comprising:

a housing having a flat base for supporting said housing on a table top;

a pair of display windows formed into said housing, said display windows on opposite sides of said housing;

a first ones counter wheel rotatably mounted in said housing for rotation in a forward or reverse direction and having an axis aligned with one of said display windows so that each portion of the perimeter of said first ones counter wheel can rotate past said one of said display windows to be viewable therethrough, the perimeter of said first ones counter wheel bearing numeric indicia in a sequence from zero to nine;

a second ones counter wheel rotatably mounted in said housing for rotation in a forward or reverse direction and connected with said first ones counter wheel to rotate together therewith, said second ones counter wheel having an axis aligned with the other of said display windows so that each portion of the perimeter of said second ones counter wheel can rotate past said other window and is viewable therethrough, said perimeter of said second counter ones wheel bearing numeric indicia in a sequence from from zero to nine, but inverted from said indicia on said first ones counter wheel;

said numeric indicia on said first and second counter wheels are located so that the same indicia on said zero to nine sequence are successively displayed in both of said display windows as said first and second ones counter wheels rotate together in either said forward or reverse direction to successive rotated positions; and means for manually advancing said ones counter wheels in either said forward or reverse direction of rotation for increasing or decreasing the count to display a selected count in both of said display windows.

2. The display counter according to claim 1 further including detent means releasably locating said first and second ones counter wheels in each successive rotated position whereat a numeral of said numeric indicia is registered with a respective one of said display windows.

3. The display counter according to claim 1 wherein said means for advancing said ones counter wheels comprises a thumb wheel connected to said first and second ones counter wheels and having a portion protruding through an opening in said housing to be manipulatable to be rotatable to rotate said ones counter wheels in either said forward or reverse direction.

4. The display counter according to claim 2 further including a tens counter wheel positioned alongside each of said first and second ones counter wheels, and means mounting each said tens counter wheel to be rotatable about an axis aligned with said axis of each of said ones counter wheels, each of said tens counter wheels bearing numeric indicia in a sequence from zero to nine and positioned so as to be successively viewable at said display windows which together with said indicia of said ones counter wheel form a two-digit numeric display at ten successive incremental rotated positions in each complete revolution of said one counter wheels;

said means mounting said tens counter wheels allows said tens counter wheels to be separately rotatable from said ones counter wheels;

coupling means causing said ones and tens counter wheels to rotate together during rotation from one of said rotated positions to the next of said ones counter wheels during each complete revolution thereof, whereby said tens counter wheel numerals viewable through said display windows increase or decrease by one count of the ones counter wheel.

5. The display counter according to claim 4 further including detent means associated with said tens counter wheels releasably locating said tens counter wheels in each successive incremental rotated position of said ones counter wheels to align the numeric indicia on the perimeter of each said tens counter wheel with the numeric indicia of said ones counter wheel alongside each said tens counter wheel in each incremental rotated position of each said ones counter wheel.

6. The display counter according to claim 5 wherein said coupling means includes a coupling element carried by one of said ones counter wheels and movable into engagement with one of said tens counter wheels; cam means engaging said coupling element only during rotation of said one of said ones counter wheels from only one of said rotated positions to the next causing said coupling element to engage said one of said tens counter wheels and cause both of said ones counter wheels and tens counter wheels to rotate together only during said rotation of said one of said ones counter wheels from said one rotated position to the next, said coupling means including return means normally urging said coupling element out of engagement with said one of said tens counter wheels to normally decouple said ones counter wheels and tens counter wheels whenever said cam means is not engaged therewith.

7. The display counter according to claim 6 wherein said coupling element comprises an elongated trip lever extending through an opening in said one of said ones counter wheels, having one end engaged by said cam means and another end projecting into an annular recess in said one of said tens counter wheel in a non-engaging posture, said cam means engaging said one end of said trip lever to cause tripping movement during rotation from one of said incremental rotated positions of said one of said ones counter wheels, said annular recess defined by a portion of said one of said tens counter wheels having a series of axially extending slots formed therein configured to receive said other end of said trip lever upon tripping movement caused by said cam means to couple said one of said ones counter wheels and said one of said tens counter wheels together.

8. The display counter according to claim 7 wherein said one of said tens counter wheels is provided with a series of resilient spring fingers, each said finger disposed within a respective slot normally resisting entrance of another end of said trip lever into a respective one of said slots, said spring fingers thereby urging said trip lever other end back out of each of said slots to comprise said return means.

9. The display counter according to claim 6 wherein said coupling element comprises an elongated pin extending axially through said one of said ones counter wheels and adapted to be periodically advanced by said cam means into one of a series of slots in said one of said tens counter wheels.

10. The display counter according to claim 9 further including a resilient blade disposed over each of said slots resisting entry of said elongate pin into each of said slots and urging said pin out of each of said slots after entry therein by operation of said cam means.

11. The display counter according to claim 6 wherein said one of said ones counter wheels is integrally formed with a resilient finger having an elongate axially extending end portion comprising said coupling element, said resilient finger comprising said return means by urging one end of said end portion out of engagement with said one of said tens counter wheels.

12. The display counter according to claim 1 wherein said housing is formed with a semi-cylindrically shaped top surface, each of said display windows disposed on opposite sides of said top surface at opposite ends of said top.

13. The display counter according to claim 1 wherein each of said ones counter wheels are identically configured molded plastic parts.

14. The display counter according to claim 6 wherein said housing includes said base, and wherein said cam means comprises a cam block attached to said base and formed with opposite cam faces engageable with said coupling element upon rotation of said one of said ones counter wheels past said cam block in either said forward or reverse direction.

15. A table top game score display counter comprising:

a housing having a flat base adapted to rest on a table top;

a pair of display windows in said housing;

an identical numeric indicia display in each of said pair of said display windows inverted from each other to be readable from opposite directions;

manually operable counter means enabling simultaneous changing of said numeric displays in both of said display windows with a single movement, whereby a single manually set score is readable from opposite directions.

16. A table top game score display counter according to claim 15 wherein said counter means includes said numeric indicia arranged on each of said counter wheels, and in inverted sequence with respect to each other but counting up or down by rotation of said counter wheels in a single direction.

17. A table top game score display counter according to claim 16 wherein said display windows are on opposite sides of said housing.

18. A table top game score display counter according to claim 17, said counter means further including a thumb-wheel rotatably fixed to each one of said counter wheels to enable advance or retraction of a score count displayed in both display windows.

* * * * *